US005611289A

United States Patent [19]

Brookes

[11] Patent Number: 5,611,289

[45] Date of Patent: Mar. 18, 1997

[54] GASIFIER FOR BIOMASS WASTE AND RELATED VOLATILE SOLIDS

[76] Inventor: David Brookes, 109A Lakeshore Rd. E., Mississauga, Ontario, Canada, L5G 1E2

[21] Appl. No.: 413,980

[22] Filed: Mar. 28, 1995

[51] Int. Cl.[6] ..... F23G 1/00

[52] U.S. Cl. ..... 110/194; 110/211; 110/165 R

[58] Field of Search ..... 110/194, 229, 110/235, 210, 211, 212, 242, 165 R

[56] References Cited

U.S. PATENT DOCUMENTS

| | | | |
|---|---|---|---|
| 4,401,038 | 8/1983 | Segrest | 110/194 |
| 4,603,644 | 5/1986 | Brookes | 110/194 |
| 5,014,630 | 5/1991 | Looker | 110/194 |

*Primary Examiner*—Henry A. Bennett
*Assistant Examiner*—Susanne C. Tinker
*Attorney, Agent, or Firm*—Donald E. Hewson

[57] ABSTRACT

A gasifier is disclosed. The gasifier comprises a primary chamber for receiving therein biomass waste material and other related volatile solids to be gasified. A fume transfer vent permits the escape of fumes from the primary chamber. A mixing chamber accepts the fumes from the fume transfer vent. The fumes then flow to an afterburner chamber where a burner member produces a heating flame so as to cause the additional full oxidization of the constituents of the fumes so as to oxidize the constituents. A partitioning wall is disposed between the flame chamber and the primary chamber so as to preclude the heating flame from entering the primary chamber and to also preclude the radiation from the heating flame from directly entering the primary chamber, thereby precluding direct contact and physical disturbance of the waste material. A heat transfer chamber in fluid communication with the afterburner chamber accepts the fully oxidized fumes therefrom. The heat from the full oxidation of the fumes causes heating of the heat transfer chamber. The primary chamber has a heat conductive floor and is superimposed on the heat transfer chamber with the heat conductive floor being disposed in separating relation therebetween so as to permit conductive and convective heating of the primary chamber, thus causing heating of the waste in the primary chamber. An exhaust vent in fluid communication with the heat transfer chamber permits venting the fumes to the ambient surroundings.

12 Claims, 5 Drawing Sheets

GASIFIER FOR BIOMASS WASTE AND RELATED VOLATILE SOLIDS

FIELD OF THE INVENTION

This invention relates to cremators and the like for processing biomass waste, such as medial waste, cadavers, and so on, and related volatile solids.

BACKGROUND OF THE INVENTION

It is necessary that various medical wastes, human cadavers, test animals, discarded medical instruments and bandages, among other things, be properly processed so that they are reduced to inert, sterile material. Very often, these forms of biomass and other related volatile solids have infectious or even deadly bacteria or viruses in them, or may contain powerful and perhaps illicit drugs, all of which must be destroyed. These forms of biomass and medical instruments and the like typically contain extremely large percentages of hydrogen, carbon, and also a number of trace elements, such as nitrogen, sulphur, iron, chlorine, magnesium, manganese, sodium and potassium, among others. It is desirable to heat all of these materials so that they are converted to gasses, preferably harmless gasses, which gasses are either elemental hydrogen, oxygen, which oxidize to water vapour and to residual carbon dioxide and to residual compounds and elements. The residuals, which are typically solids at ambient room or environmental temperature, should end up as inert mineral materials.

In order to accomplish the reduction of such biomass waste and related volatile solids into relatively inert gasses and minerals salts, alloys, or other compounds, it is necessary to heat these materials sufficiently so as to break the chemical bonds between the molecular structures. Intense heating is required to break the various chemical bonds, such as hydrogen-carbon bonds. It is necessary that essentially all of the hydrogen-carbon bonds be broken, as the bonds are typically found in organic material, which organic material must be destroyed. Such extreme heating of such materials in this manner is known as pyrolysis, which is defined as chemical decomposition by action of heat. Typically, such pyrolysis is carried out at temperatures in the order of 1,000° C. for periods of about 6 to 8 hours. The ash material that is ideally produced, which ash material is composed mostly of mineral salts, will glow an orangey-red colour when it is at 1,000° C. and will ultimately be a white ash when it has cooled. The main constituents of the organic materials, namely hydrogen and carbon, are gasified, to form mainly carbon dioxide and water.

What is not desirable as an end product, and is even unacceptable, is black colored ash. Such black colored ash indicates that the ash is not completely reduced and there is still carbon and hydro-carbon material, among other materials, in the ash. The ash, therefore, might contain organic material therein, which organic material might even be in the form of bacteria or viruses, or might be chemical compounds, including toxic materials, such as dioxins, furans and other organo-chlorides.

Basically, the heat causes the waste material to process itself, which processing mostly includes the pyrolytic breaking of the various chemical bonds, such as hydrogen-carbon bonds so as to permit gasification of all the materials possible.

BRIEF DESCRIPTION OF THE DRAWINGS

Embodiments of this invention will now be described by way of example in association with the accompanying drawings in which.

DESCRIPTION OF THE PRIOR ART

Nearly all biomass incineration takes place in an incinerator that comprises at least two chambers—a primary chamber into which the biomass charge is placed for incineration, and either a secondary or heat transfer chamber that is in heat transfer relationship to the primary chamber, or an afterburner chamber that passes to the exit flue for the incinerator.

In order to obtain volatization of all of the biomass material in the primary chamber, it is necessary to break the bonds—mainly hydrogen-carbon bonds—between the various molecules. This breaking of the bonds is essentially a chemical reaction, generally an endothermic chemical reaction, and requires that an amount of external heat energy be introduced into the material in order for the various reactions to take place. Oxidation reactions are exothermic, these reactions provide for the release of heat energy from the reacted materials. This released heat energy in the afterburner chamber tends to cause an increase in the temperature in the primary chamber, which increase in temperature therefore tends to urge those materials towards their volatilization temperatures.

If the external heat energy introduced into the biomass material is at a very high temperature or is applied very abruptly, especially in a concentrated area, then two things tend to happen: Firstly, any reactions that occur tend to be rather violent, thus causing the production of fly-ash into the fumes of the volatilizing biomass; secondly, the sudden and concentrated reactions produce a large amount of heat energy, which in turn can cause the abrupt volatilization of the surrounding material, which volatilization can be somewhat violent. Further, if a substantial amount of material is volatilized, in the manner discussed immediately above, over a relatively short period of time, then the ambient temperature of the primary chamber will tend to rise substantially, thus causing the remaining biomass to be volatilized more quickly, but not at a controlled rate. In other words, the reaction is, at least to some degree, out of control.

In order to have a continuing volatilization reaction that is generally controllable and that is free from abrupt changes in heat generation rates and reaction rates, and which is therefore relatively free from abrupt physical disturbances, it is necessary to apply external heat energy so as to effect a continuing slow rise in temperature of the biomass material to its volatilization point.

All known prior art incinerators and cremators are designed to use relatively forceful techniques, in terms of the application of heat to a biomass material, in order to volatilize the biomass material. Essentially, all known prior art incinerators use "brute force" to cause the required volatilization, based on the assumption that more heat energy input will cause more chemical reaction and volatization.

Figure 1:
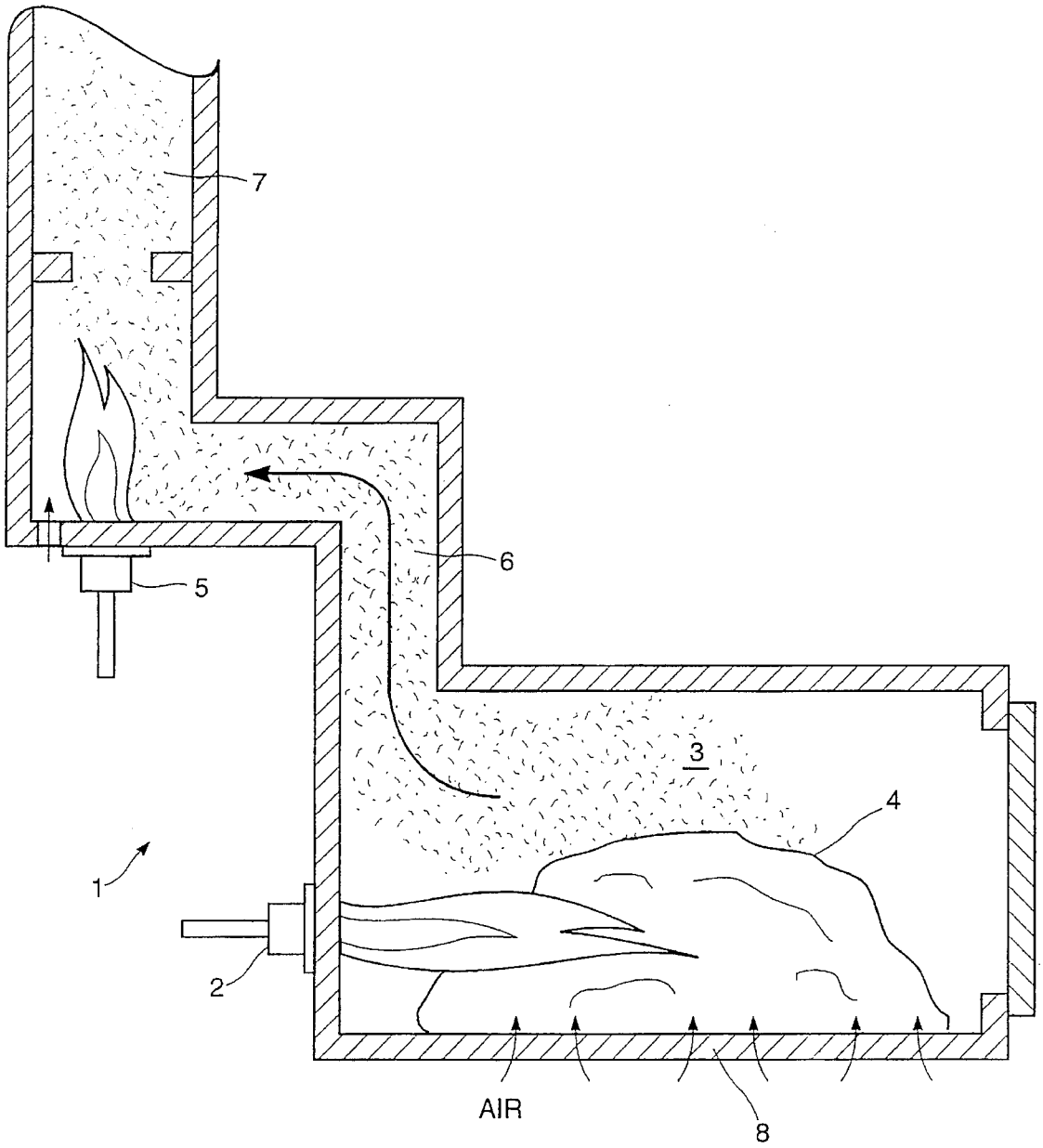
FIG 1 (PRIOR ART)
FIG. 1 is a sectional side elevational view of a first prior art incinerator.

Traditional incinerators and cremators, an example of which is shown in prior art FIG. 1, as indicated by general reference numeral 1, employ two or more burners, with a first burner 2 being in the primary chamber 3 of the incinerator 1—the primary chamber being where the biomass charge or other material for incineration is placed—and a second burner 5 being located in the fume vent 6. The first burner 2 in the primary chamber 3 is directed at the biomass 4 and is intended to initially ignite the biomass 4. It is found, however, that the fumes that are driven off contain a great deal of materials, such as fly-ash, having hydrogen-carbon bonds, and other unincinerated materials. Therefore, the second burner 5 is included so as to act as an afterburner to further burn the materials that are found in the fumes. However, relatively large pieces of material, such as fly-ash, may contain several million or billion molecules; and, accordingly, such pieces of material as are borne by the fumes may not get fully incinerated in the time that they take to pass through the afterburner chamber 7.

The first burner 2 in the primary chamber 3 is aimed directly at the biomass 4, or other material to be incinerated, so as to cause direct burning of the biomass 4. The flame tends to cause the biomass waste to inflame and also tends to physically agitate the biomass 4. Resultingly, an undesirably high amount of fly-ash is included within the fumes from the burning biomass 4. The fume and the fly-ash contain unburned materials which may be organic materials, and also which might include unwanted dangerous chemicals such as dioxins, furans and organo-chlorides.

Further, this type of conventional prior art incinerator 1 does not provide sufficient heat intensity on an overall basis to properly incinerate all of the waste material. Only localized heat is provided by way of the first burner 2 within the primary chamber 3, which first burner 2 incinerates the exterior of the biomass 4, and also by way of the floor 8 of the primary chamber 1, which floor 8 eventually heats up sufficiently so as to cause burning of the biomass 4 immediately in contact with it. There is often not enough heat intensity to cause complete gasification even of the materials that do burn, and certainly not enough heat intensity to cause complete gasification of the waste material at the centre of the biomass. Indeed, it has been found that the waste material at the centre of the biomass charge 4 does not burn much at all. The ash that is produced is still black, which indicates that the ash is composed largely of carbon. It has been found that typically there is also undesirable material such as dioxins, furans and organo-chlorides, and other organic matter. This black ash is typically about 10% to 15% by volume of the original waste material (and about 15% to 25% by weight).

Figure 2:
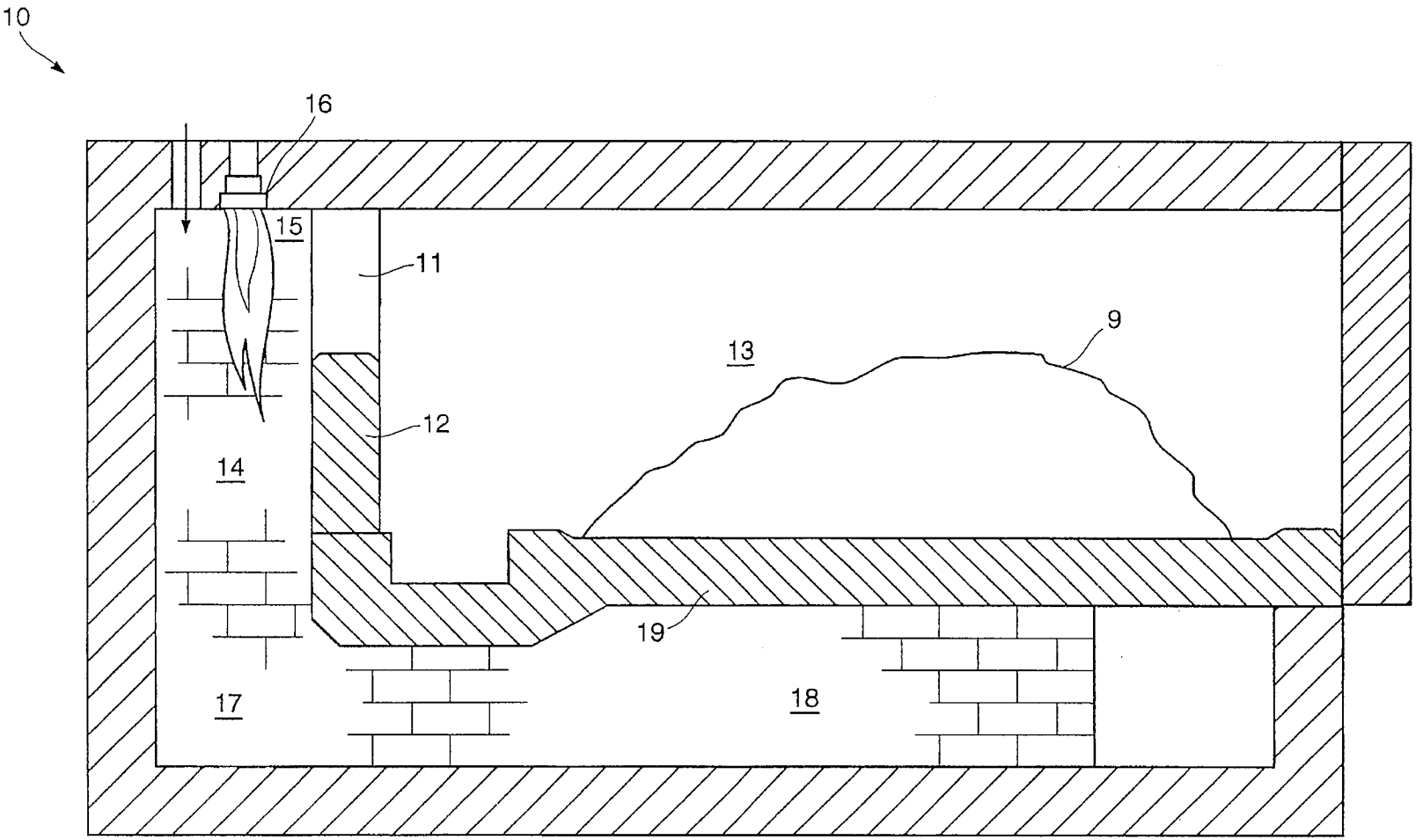
FIG 2 (PRIOR ART)
FIG. 2 is a sectional side elevational view of a second prior art incinerator.

FIG. 2 discloses an improved incinerator and cremator that overcomes some of the problems encountered with conventional prior art incinerators and cremators. This incinerator is essentially that which is taught in the present inventor's U.S. Pat. No. 4,603,644, issued Aug. 5, 1986. The incinerator and cremator taught in that patent, and as indicated by the general reference numeral 10, has a vent 11 in the back wall 12 of the primary chamber 13, which vent 11 leads to a vertically disposed flame chamber 14. The flame chamber 14 comprises first a mixing chamber 15 wherein the flame from the sole burner member 16 mixes with the fumes from the primary chamber 13, and an afterburner chamber 17 where the fumes from the mixing chamber 15 are reacted—so as to break the hydrogen-carbon bonds—and gasify the materials in the fumes. This process is known as "cracking". The afterburner chamber turns a 90° corner, where the majority of "cracking" takes place. A relatively short horizontally disposed portion of the afterburner chamber 17 leads into a generally horizontally disposed heat transfer chamber 18. The heat from the "cracking" of the hydrogen-carbon bonds in the afterburner chamber 17 causes an elevation of temperature, to about 1,000° C., of the heat transfer chamber. The heat within the heat transfer chamber rises through the roof 19 of the heat transfer chamber, which is also the floor of the primary chamber, so as to heat the primary chamber and the biomass 9 within the primary chamber 13. In this manner, the biomass 9 receives conductive and convective heat from the heat transfer chamber 18, which conductive and convective heat assist in the heating of the biomass 9 in the primary chamber 13. The burner member 16 is located at the top portion of the mixing chamber 15, immediately beside the vent 11 from the primary chamber 13. Accordingly, the flame from the burner member 16 provides direct radiant heat into the primary chamber 13 through the vent 11. This direct radiant heat reaches the biomass 9 being incinerated and partially assists in the heating of the biomass 9 (known as "direct radiant heat volatilization"). Such incineration by way of direct radiant heat tends to cause burning of the biomass 9 so as to cause premature ignition which leads to incomplete combustion in the early stages of the process. An ignition burner 19 is also included to assist with combustion of the waste mass. The firing of this burner can cause instability in the primary chamber and cause the emission of fly-ash material. Some of the fly-ash becomes gasified within the afterburner chamber 17; however, it is quite possible that some of the fly-ash can pass through the afterburner chamber 17 without being completely gasified. Such incomplete gasification is generally unacceptable as this material might include hydrocarbons, dioxins, furans, and other unwanted organic matter such as bacteria, viruses, and other micro-organisms.

All known prior art incinerators and cremators use one or more, and possibly even several, control systems in order to try to stabilize the temperature within the primary chamber. It has been found that the use of such multiple control systems tends to produce an overall system wherein the temperature in the primary chamber may vary and, therefore, cannot be considered stable. Such lack of stability is caused by the plurality of control systems essentially working against each other.

It has been found that all prior art incinerators and cremators, due to the inherent nature of the incineration process that occurs, produce an unacceptable end product. The fumes that are produced have relatively high levels of hydro-carbons, dioxins, furans, among other materials and substances, and also may contain fly-ash, while the resulting ash remaining in the incinerator may have unwanted organic matter such as bacteria, viruses, and other microorganisms. It can therefore be seen that incineration of biomass waste and related volatile solids is generally unacceptable as it does not render potentially infectious waste totally safe.

What is needed is a means of gasifying biomass waste and related volatile solids that slowly and unabruptly applies heat to the material being incinerated, so as to cause a continuous and controlled rise in temperature of the biomass material.

SUMMARY OF THE INVENTION

In accordance with one aspect of the present invention, there is provided a gasifier for fully gasifying biomass waste and related volatile solids, and also the fumes from the material being processed. The biomass gasifier comprises a primary chamber shaped and dimensioned to receive therein a charge of material to be gasified and includes a door member to permit selective access to the primary chamber. A fume transfer vent is disposed near the top of the primary chamber, the fume transfer vent being in fluid communication with the primary chamber, to permit the escape of fumes from the primary chamber. A mixing chamber is in fluid communication with the fume transfer vent to accept the fumes from the primary chamber. An afterburner chamber is in fluid communication with the mixing chamber. A burner member is situated in the gasifier so as to produce a heating flame within a first vertically disposed portion of the afterburner chamber, which flame causes the additional full oxidation of the constituents of the fumes so as to resolve the constituents. The burner member has a fuel inlet and an oxygen gas inlet to permit the supply of fuel and oxygen gas, respectively, to the burner member, and control means to control the supply of fuel and oxygen to the burner member. The afterburner chamber is shaped and dimensioned to permit the heating flame to combust or oxidize substantially all of the constituents of the fumes. A partitioning wall is disposed between the flame chamber and the primary chamber, and is positioned and dimensioned to preclude the heating flame from entering the primary chamber and also to preclude the radiation from the heating flame from directly entering the primary chamber. A heat transfer chamber is in fluid communication with the afterburner chamber. The heat from the oxidization of the fumes received from the afterburner chamber causes heating of the heat transfer chamber. The primary chamber has a heat conductive floor and is superimposed on the heat transfer chamber with the heat conductive floor being disposed in separating relation therebetween so as to permit conductive and convective heating of the primary chamber, thus causing heating of the contents in the primary chamber. There is an exhaust vent in fluid communication with the heat transfer chamber for venting the resolved gasses to the ambient surrounding.

DETAILED DESCRIPTION OF THE PREFERRED EMBODIMENTS

Figure 3:
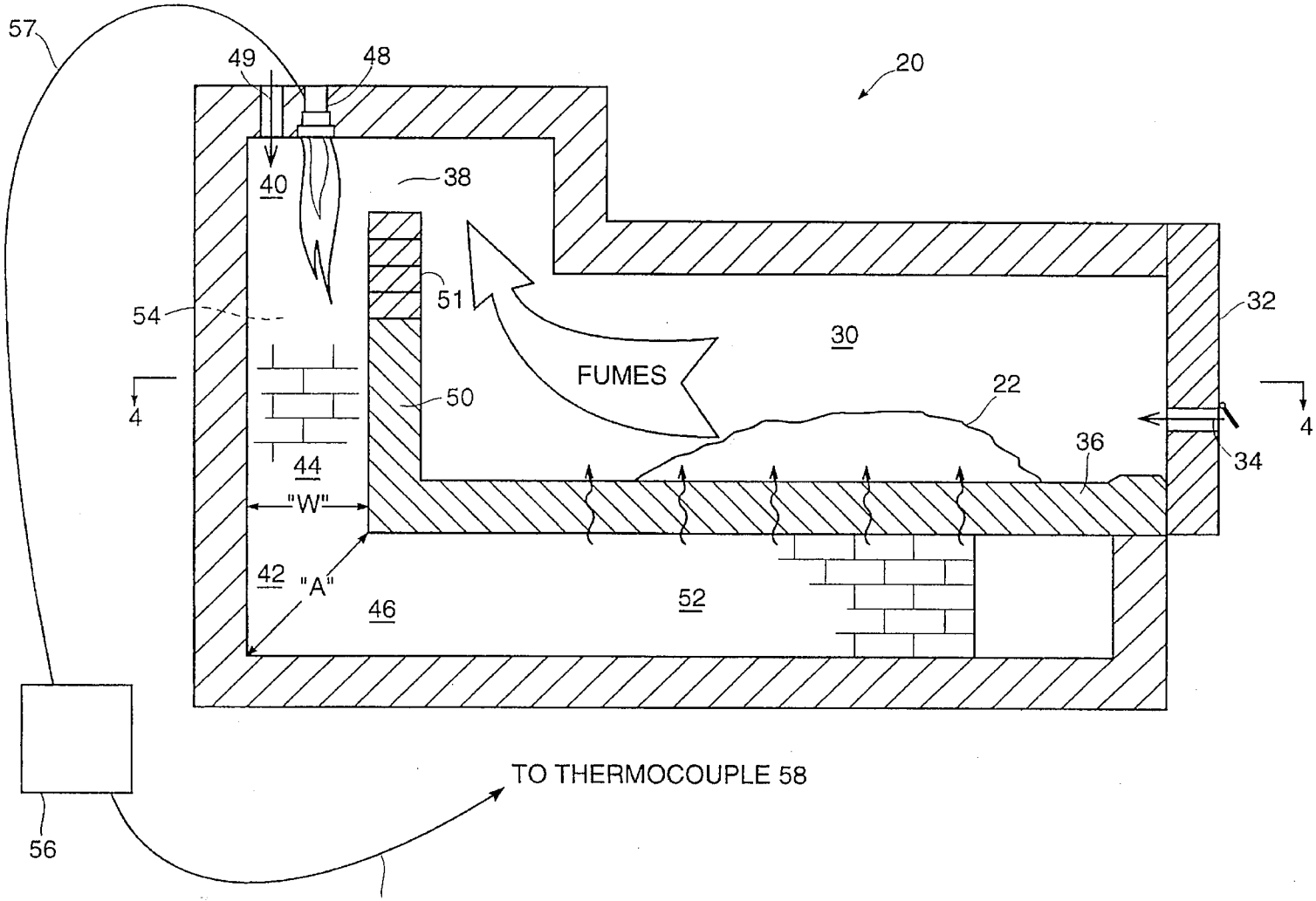
FIG. 3 is a sectional side elevational view of a preferred embodiment of the present invention.
Figure 4:
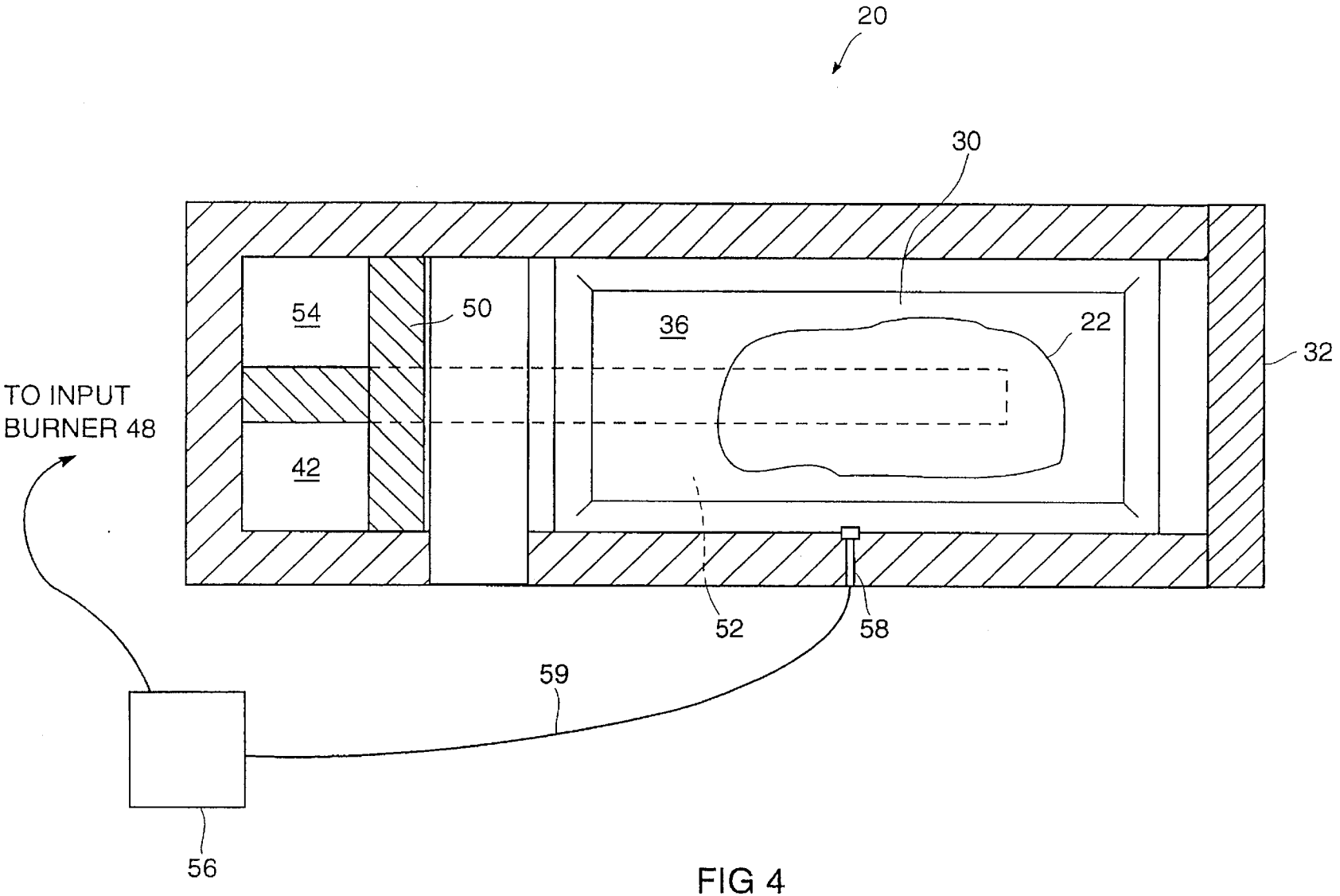
FIG. 4 is a sectional top plan view of the preferred embodiment of FIG. 3, taken along section line 4—4.

Reference will now be made to FIGS. 3 and 4, which show the preferred embodiment of the gasifier of the present invention, as indicated by the general reference numeral 20. The gasifier 20 comprises a primary chamber 30 shaped to receive therein a charge of waste material 22 to be gasified. The primary chamber 30 includes a main door 32 to permit selective access to the primary chamber. A low volume air inlet 34 may be included in the door member 32 for permitting the inflow of small amounts of air or oxygen into the primary chamber 30. The floor 36 of the primary chamber 30 is made of a suitable refractory material so as to be strong enough to support the weight of any material placed therein, which may be several thousand pounds. The floor 36 is also heat-conductive so as to allow heat to enter the primary chamber 30 from below, as will be discussed in greater detail subsequently.

A fume transfer vent 38 is located at the back of the primary chamber 30 and disposed near the top of the primary chamber. The fume transfer vent 38 is in fluid communication with the primary chamber 30 so as to permit the escape of fumes from the primary chamber 30 when the charge of waste material 22 is being gasified therein. The fumes from the fume transfer vent 38 comprise gasses and also molecules having hydrogen, carbon, and oxygen atoms therein, with many of the constituents having hydrogen and carbon bonded together, accordingly with hydrogen-carbon bonds.

A vertically disposed mixing chamber 40 is in fluid communication with the fume transfer vent 38 and thereby accepts the fumes from the primary chamber 30. An afterburner chamber 42 is in fluid communication with the mixing chamber 40. In the preferred embodiment, the afterburner chamber has a vertically disposed first portion connected at a 90° corner, as indicated by double-headed arrow "A", to a horizontally disposed second portion 46. The "corner to corner" width at the 90° corner is greater than the width of the afterburner chamber 42 so as to maximize the effect of the afterburner chamber 42, as will be discussed in greater detail subsequently. The afterburner is thereby shaped and dimensioned to permit the heating flame to fully oxidize substantially all of the constituents of the fumes from the primary chamber.

A burner member, in the form of an auxiliary heat input burner 48 is situated at the top of the mixing chamber and is oriented so as to project a heating flame downwardly through the mixing chamber 40 and into the first vertically disposed portion of the afterburner chamber 42. The heating flame from the auxiliary heat input burner 48 causes additional oxidization of the constituents of the fumes so as to completely resolve the main portion of these components into carbon dioxide and water vapour—water vapour being a gas at and above temperatures of about 100° C.

The mixing chamber permits mixing of the constituents of the fumes from the primary chamber 30 with the ambient air in the mixing chamber and also with the oxygen from an oxygen inlet 49 that is juxtaposed with the auxiliary heat input burner 48.

The auxiliary heat input burner 48 has a fuel inlet and an air inlet to permit the supply of fuel and oxygen gas, respectively, to the input burner 48. A control means is operatively connected to the input burner 48 by way of wires 57, and is used to control the supply of fuel to the input burner 48. It is typically necessary to adjust the flow of fuel to the auxiliary heat input burner 48 initially so as to produce a substantial heating flame that extends into the afterburner chamber 42. As the afterburner chamber 42 generally increases in temperature, the flow of fuel to the auxiliary heat input burner 48 is typically decreased, as less input is required to keep the afterburner chamber 46 at a generally constant temperature once the gasification process is underway.

A partitioning wall 50 is disposed between the mixing chamber 40 and the primary chamber 30 and also between the vertically disposed first portion 44 of the afterburner chamber 42 and the primary chamber 30. The partitioning wall 50 is positioned and dimensioned to preclude the heating flame produced by the auxiliary heat input burner 48 from entering the primary chamber 30, and also to preclude the radiation from the heating flame from directly entering the primary chamber 30. In this manner, the heating flame does not directly heat the waste material 22 in the primary chamber and, therefore, does not abruptly overheat a localized area of the material. Particularly, the partitioning wall 50 precludes physical agitation of the material 22 by the heating flame from the auxiliary heat input burner 48, thereby precluding the production of fly-ash from the waste material 22 as the material 22 is being heated and gasified.

In the preferred embodiment, the partitioning wall 50 is variable in height by way of the subtraction or addition of bricks 51 therefrom, so as to allow for "fine tuning" of the cross-sectional area of the fume transfer vent 38. It is preferable to block the primary chamber 30 from the effects of the auxiliary heat input burner 48 as much as possible; however, it is preferable to keep the fume transfer vent 38 as large as reasonably possible so as to allow for ready escape of the fumes from the primary chamber 30. It can be seen that maximizing the height of the partitioning wall 50 and also maximizing the cross-sectional area of the fume transfer vent 38 is a trade-off and, therefore, the height of the partitioning wall is often best determined through empirical testing. Such empirical testing may be dangerous and should be performed by a highly qualified professional only.

In the afterburner chamber 42, the hydrogen-carbon bonds in the various materials, among other bonds, break down and oxidize so as to produce a net exothermic reaction. The breaking of the hydrogen-carbon bonds, which is known in the industry as "cracking", takes place largely at the 90° corner between the vertically disposed first portion 44 and the horizontally disposed second portion 46 of the afterburner chamber 42. This corner is, therefore, often referred to as the "cracking zone". It has been found that by constructing this 90° corner with certain considerations, the "cracking" of the hydrogen-carbon bonds takes place in the "cracking zone" so as to fully oxidize, within the afterburner chamber 42, the major portion of the constituents of the fumes received from the primary chamber 30.

As the fumes exit the horizontally disposed second portion 46 of the afterburner chamber, they enter the heat transfer chamber 52. The heat from these exothermic reactions causes the heating of the heat transfer chamber 52 to a very high temperature, ultimately to about 1,000° C. This temperature is, of course, adjustable by way of the control means 56 of the auxiliary heat input burner 48. As the heat from the "cracking" of the hydrogen-carbon bonds, in addition to the residual heat from the auxiliary heat input burner 48, increases the temperature within the heat transfer chamber 52, the control means 56 can be used to decrease the heating flame being projected from the auxiliary heat input burner 48. This control means 56 can be interfaced with a thermocouple 58 that senses the temperature within the heat transfer chamber 52. The thermocouple 58 is electrically connected by way of wires 59 to the control means 56 so as to provide feedback signals to the control means, thereby allowing for automatic adjustment of the heating flame from the auxiliary heat input burner 48. In the preferred embodiment, the heat transfer chamber 52 is bifurcated so as to increase the effective length of the heat transfer chamber 52, thus increasing the amount of time the hot gasses within the heat transfer chamber are exposed to the floor 36 of the primary chamber 30 above, and thereby permitting more heat to be transferred from the heat transfer chamber 52 to the primary chamber 30.

The primary chamber 30 is superimposed on the heat transfer chamber 52, with the heat conductive floor 36 disposed in separating relation therebetween, such that the heat from the heat transfer chamber 52 passes through the heat conductive floor 36 so as to permit conductive and convective heating of the primary chamber 30, to thereby increase the temperature of the primary chamber 30.

The heat transfer chamber 52 is in fluid communication with a vertically disposed exhaust vent 54 located at the rear of the primary chamber 30. The exhaust vent 54 allows for the safe venting of the oxidized fumes into the ambient surroundings.

It can be seen that, in the preferred embodiment of the present invention, as shown in FIGS. 3 and 4, the various chambers are juxtaposed one to another so as to have common walls between one another to thereby conserve and recirculate the heat energy from the auxiliary heat input burner 48 and from the exothermic reactions from the volatilization and gasification of the waste materials.

The temperature within the primary chamber can be controlled in two ways: Firstly, as discussed above, the auxiliary heat input burner 48 is modulated by way of the control means 56 receiving feedback from a thermocouple 58 within the heat transfer chamber 52. The fuel input and, therefore, the size of the flame from the auxiliary heat input burner 48 is selected according to the temperature experienced by the thermocouple 58. Secondly, a small amount of air can be permitted to pass into the primary chamber 30 by way of the low volume air inlet 34 in the main door 32 of the primary chamber 30. Permitting a very small amount of air into the primary chamber 30 can raise the temperature within the primary chamber 30. Care must be taken, however, not to permit too much air into the primary chamber 30 in this manner as a significant increase in temperature might be experienced, therefore effectively destabilizing the gasification process.

When the auxiliary heat input burner 48 is started, the heat from the auxiliary heat input burner 48 heats up the heat transfer chamber 52, so as to thereby slowly and steadily cause a rise in temperature of the primary chamber 30. As the temperature in the primary chamber 30 rises, volatilization of the low enthalpy portions of the waste material 22 starts to occur, as the low enthalpy material 22 has, by definition, lower bond energy. The exothermic reactions of the low enthalpy material 22 which occur in the primary chamber 30 and in the "cracking zone" of the afterburner chamber 42, combine with the heat from the auxiliary heat input burner 48 to continue to heat up the heat transfer chamber 52, so as to cause a steady and continuous rise in the temperature within the primary chamber 30. As the temperature within the primary chamber 30 increases, the higher enthalpy portions of the waste material 22 is volatilized, thus producing even more heat energy from the resulting exothermic reactions. This increased heat energy continues to combine with the heat energy from the auxiliary heat input burner 48, so as to continue to add heat into the heat transfer chamber 52 and, accordingly, increase the temperature of the primary chamber 30. It can be seen that there is a steady and continuous increase in the amount of heat energy given off by way of exothermic reaction of the waste material 22 over time. All the while, the thermocouple 58 in the primary chamber 30 allows for monitoring of the temperature of the heat transfer chamber 52 and permits the auxiliary heat input burner 48 to modulate itself so as to preclude the heat within the heat transfer chamber 52 from rising excessively. Essentially, the increase in temperature within the primary chamber 30 is based on the slow rise in heat energy from the continuing exothermic reactions of the material 22. In this manner, the overall process that occurs within the gasifier 20 of the present invention is self-supervising and self-stabilizing, which is not possible whatsoever in any prior art incinerator or cremator.

In the above described manner, the gasifier of the present invention reduces solid waste matter to a small amount of predominantly white ash, which is a complex mineral material formed of mineral salts. There is no organic matter remaining. The amount of white ash is about 2% to 3% by volume of the original volume of the charge of material 22 originally introduced into the primary chamber 30.

Figure 5:
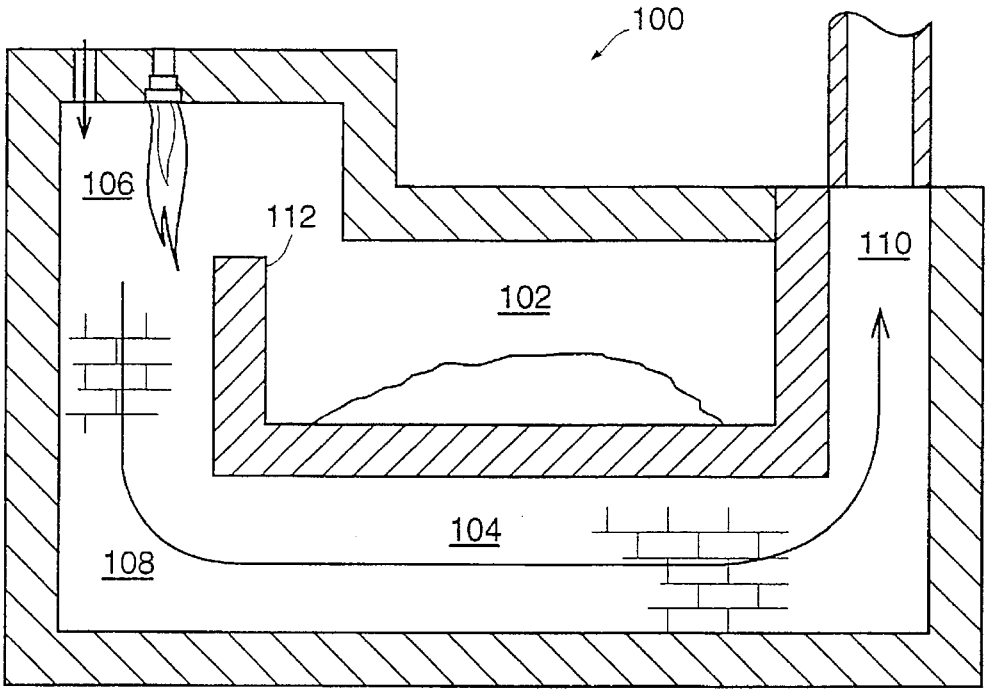
FIG. 5 is a sectional front elevational view of a first alternative embodiment of the present invention.

Reference will now be made to FIG. 5, which shows the first alternative embodiment of the present invention, wherein the alternative embodiment gasifier 100 has a centrally disposed primary chamber 102 over top a heating chamber 104. The mixing chamber 106 and the afterburner chamber 108 are disposed at one side of the incinerator 100 and the vertically disposed exhaust vent 110 is located at the other opposite side of the incinerator 100. A partitioning wall 112 is disposed between the mixing chamber 106 and the primary chamber 102.

Figure 6:
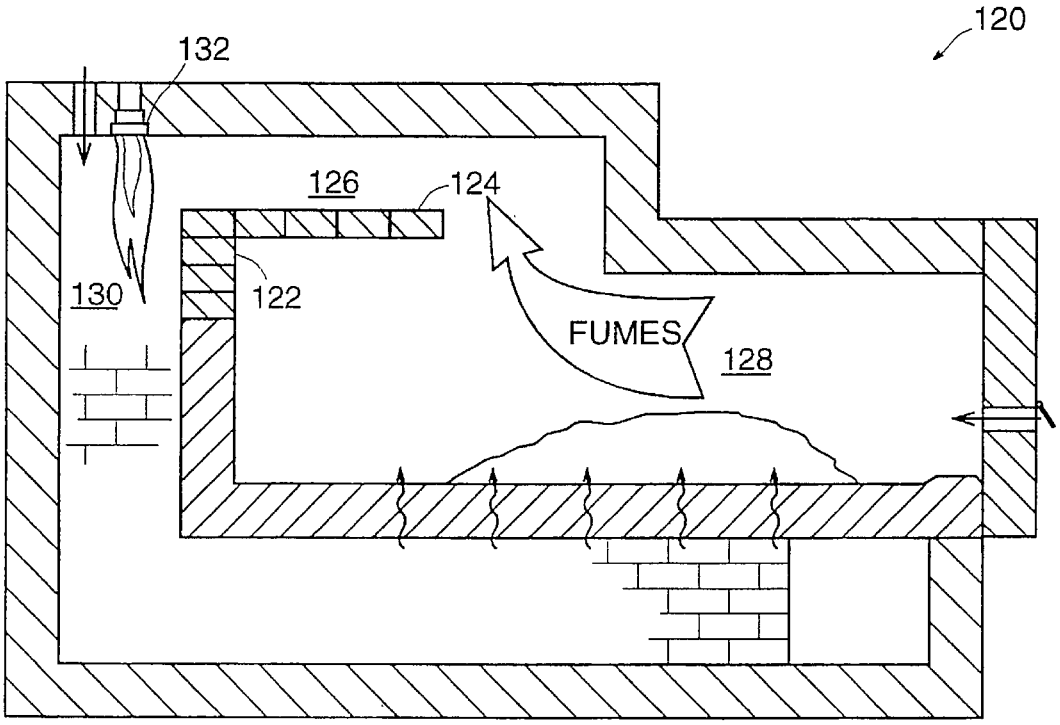
FIG. 6 is a sectional side elevational view of a second alternative embodiment of the present invention.

In a second alternative embodiment, as shown in FIG. 6, the gasifier 120 has a partitioning wall 122 with a horizontally extending portion 124. The horizontally extending portion creates a horizontally disposed tunnel 126 between the primary chamber 128 and the mixing chamber 130. This tunnel 126 is, in essence, an elongate fume transfer vent. Such a horizontally extending portion 124 on the partitioning wall 122 provides for even greater separation of the auxiliary heat input burner 132 and the primary chamber 128.

Other modifications and alterations may be used in the design and manufacture of the apparatus of the present invention without departing from the spirit and scope of the accompanying claims.

What is claimed is:

1. A gasifier for use in gasifying biomass waste and related volatile solids, said gasifier comprising:

a primary chamber shaped and dimensioned to receive therein waste material to be gasified and including a door member to permit selective access to said primary chamber;

a fume transfer vent disposed near the top of said primary chamber, said fume transfer vent being in fluid communication with said primary chamber, to permit the escape of fumes from said primary chamber;

a mixing chamber in fluid communication with said fume transfer vent to accept said fumes from said primary chamber;

an afterburner chamber in fluid communication with said mixing chamber;

a burner member situated in said gasifier so as to produce a heating flame within a first vertically disposed portion of said afterburner chamber, which flame causes the additional full oxidization of the constituents of said fumes so as to oxidize or resolve said constituents, said burner member having a fuel inlet and an air inlet to permit the supply of fuel and oxygen gas, respectively, to said burner member, and control means to control the supply of fuel and oxygen to said burner member;

wherein said afterburner chamber is shaped and dimensioned to permit said heating flame to oxidize substantially all of the constituents of said fumes;

a partitioning wall disposed between said mixing chamber and said primary chamber, wherein said partitioning wall defines the bottom limit of said transfer vent and wherein said partitioning wall and said frame transfer vent are together positioned and dimensioned to preclude said heating flame from entering said primary chamber and to also preclude the radiation from said heating flame from directly entering said primary chamber;

a heat transfer chamber in fluid communication with said afterburner chamber, wherein the heat from the full oxidization of said fumes causes heating of said heat transfer chamber;

wherein said primary chamber has a heat conductive floor and is superimposed on said heat transfer chamber with said heat conductive floor being disposed in separating relation therebetween so as to permit conductive and convective heating of said primary chamber;

an exhaust vent in fluid communication with said heat transfer chamber for venting said fumes into said ambient surroundings.

2. The gasifier of claim 1, wherein said mixing chamber is generally vertically disposed.

3. The gasifier of claim 2, wherein said burner member is disposed at the top of said mixing chamber.

4. The gasifier of claim 3, wherein said partitioning wall is variable in height.

5. The gasifier of claim 1, wherein said afterburner chamber has a vertically disposed first portion and a horizontally disposed second portion.

6. The gasifier of claim 5, wherein said vertically disposed first portion of said afterburner chamber is connected in fluid communication to said horizontally disposed second portion of said afterburner chamber by way of a 90° corner.

7. The gasifier of claim 6, wherein said 90° corner has a "corner to corner" distance that is greater than the width of the afterburner chamber, so as to thereby effectively increase the cross-sectional area of the afterburner chamber at that point.

8. The gasifier of claim 1, wherein said heat transfer chamber is bifurcated.

9. The gasifier of claim 1, wherein said fume transfer vent is located behind said primary chamber.

10. The gasifier of claim 1, wherein said exhaust vent is at the back of said primary chamber.

11. The gasifier of claim 1, wherein said fume transfer vent is in the form of a tunnel.

12. The gasifier of claim 1, further comprising a control means operatively connected to a thermocouple disposed within said heat transfer chamber, said thermocouple providing feedback signals to said control means, said control means being operatively connected to said auxiliary heat input burner so as to permit control of the supply of fuel and oxygen to said burner.

* * * * *

UNITED STATES PATENT AND TRADEMARK OFFICE

CERTIFICATE OF CORRECTION

PATENT NO. : 5,611,289
DATED : March 18, 1997
INVENTOR(S) : Brookes, David

It is certified that error appears in the above-identified patent and that said Letters Patent is hereby corrected as shown below:

Claim 1, line 51, after "between" --and in direct contact with the interiors of -- has been inserted--.

Signed and Sealed this

Thirteenth Day of January, 1998

Bruce Lehman

*Attest:*

BRUCE LEHMAN

*Attesting Officer*

*Commissioner of Patents and Trademarks*